US008944976B2

(12) United States Patent
Crowell et al.

(10) Patent No.: US 8,944,976 B2
(45) Date of Patent: Feb. 3, 2015

(54) EXERCISE DEVICE

(71) Applicant: The Hygenic Corporation, Akron, OH (US)

(72) Inventors: Jason Crowell, Akron, OH (US); Phillip Andrew Page, Baton Rouge, LA (US); Paul Reed Timko, Lorain, OH (US)

(73) Assignee: The Hygenic Intangible Property Holding Company LLC, Akron, OH (US)

( * ) Notice: Subject to any disclaimer, the term of this patent is extended or adjusted under 35 U.S.C. 154(b) by 0 days.

(21) Appl. No.: 13/766,687

(22) Filed: Feb. 13, 2013

(65) Prior Publication Data

US 2013/0157821 A1 Jun. 20, 2013

Related U.S. Application Data

(63) Continuation-in-part of application No. 13/223,437, filed on Sep. 1, 2011.

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 21/055*** | (2006.01) |
| ***A63B 21/068*** | (2006.01) |
| ***A63B 21/16*** | (2006.01) |
| ***A63B 23/035*** | (2006.01) |
| *A63B 23/00* | (2006.01) |

(52) U.S. Cl.

CPC ..... *A63B 21/0442* (2013.01); *A63B 21/00185* (2013.01); *A63B 21/0552* (2013.01); *A63B 21/0555* (2013.01); *A63B 21/0557* (2013.01); *A63B 21/068* (2013.01); *A63B 21/1469* (2013.01); *A63B 21/1663* (2013.01); *A63B 23/0355* (2013.01); *A63B 23/03575* (2013.01); *A63B 21/00043* (2013.01); *A63B 2023/006* (2013.01); *A63B 2017/0694* (2013.01)

USPC ..... 482/125; 482/121; 482/122

(58) Field of Classification Search

USPC ..... 482/91–96, 120, 121, 129, 130, 139, 482/143, 23, 38, 39, 40, 122, 124–126

See application file for complete search history.

(56) References Cited

U.S. PATENT DOCUMENTS

| | | | | | |
|---|---|---|---|---|---|
| 4,060,240 | A | * | 11/1977 | Dunston | 482/131 |
| 4,220,328 | A | | 9/1980 | Cruch, Jr. | |
| 5,209,712 | A | | 5/1993 | Ferri | |
| 5,556,369 | A | | 9/1996 | Roberts | |
| 5,571,064 | A | | 11/1996 | Holm | |
| 5,624,359 | A | * | 4/1997 | Dean | 482/91 |
| 5,816,984 | A | | 10/1998 | Weiss | |

(Continued)

*Primary Examiner* — Loan H Thanh
*Assistant Examiner* — Nyca T Nguyen
(74) *Attorney, Agent, or Firm* — Baker & Hostetler LLP

(57) ABSTRACT

An exercise device includes a first strap portion having a first elongate portion and a second elongate portion joined together along a common longitudinal axis at varying points to define a first plurality of loops, a second strap portion having a third elongate portion and a fourth elongate portion joined together along a second common longitudinal axis at varying points to define a second plurality of loops, and an anchoring device. The first strap portion and the second strap portion are coupled to one another and the anchoring device is configured to hold or secure the coupled first and second strap portions such that the first plurality of loops and the second plurality of loops extend substantially symmetrically away from the anchoring device.

11 Claims, 10 Drawing Sheets

(56) References Cited

U.S. PATENT DOCUMENTS

| | | | | |
|---|---|---|---|---|
| 5,885,190 | A | 3/1999 | Reiter | |
| 6,179,751 | B1 | 1/2001 | Clears | |
| 6,322,483 | B1 | 11/2001 | Rotella | |
| 6,368,255 | B1 | 4/2002 | Chan-Rouse | |
| 6,450,929 | B1 | 9/2002 | Markham | |
| 6,726,606 | B2 | 4/2004 | Jacobsen | |
| 6,921,354 | B1 * | 7/2005 | Shifferaw | 482/91 |
| 7,044,896 | B2 | 5/2006 | Hetrick | |
| 7,090,622 | B2 * | 8/2006 | Hetrick | 482/92 |
| 7,438,674 | B2 | 10/2008 | Sjodin | |
| 7,585,197 | B1 * | 9/2009 | Merten | 441/80 |
| 7,651,451 | B2 | 1/2010 | Jensen | |
| 7,722,508 | B2 | 5/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 7,811,202 | B2 | 10/2010 | Planke | |
| D636,036 | S | 4/2011 | Rios | |
| 8,043,197 | B2 | 10/2011 | Hetrick | |
| 8,083,653 | B2 | 12/2011 | Hetrick | |
| 8,088,053 | B2 | 1/2012 | Whyatt et al. | |
| 8,096,922 | B2 | 1/2012 | Planke | |
| 8,157,712 | B1 * | 4/2012 | Musachio | 482/121 |
| 8,192,337 | B2 * | 6/2012 | Birch et al. | 482/129 |
| 8,197,392 | B2 | 6/2012 | Silverman et al. | |
| 2002/0187884 | A1 * | 12/2002 | McGrath | 482/121 |
| 2004/0067827 | A1 | 4/2004 | Tustin | |
| 2004/0215114 | A1 * | 10/2004 | Cruz | 601/132 |
| 2007/0027005 | A1 | 2/2007 | Hetrick | |
| 2007/0265145 | A1 | 11/2007 | Teng | |
| 2008/0132392 | A1 * | 6/2008 | Moulton | 482/122 |
| 2009/0075788 | A1 * | 3/2009 | Hetrick | 482/91 |
| 2009/0075790 | A1 | 3/2009 | Hetrick | |
| 2009/0197747 | A1 | 8/2009 | Chan et al. | |
| 2010/0113235 | A1 * | 5/2010 | Calvagne et al. | 482/143 |
| 2010/0292054 | A1 | 11/2010 | Karpus et al. | |
| 2011/0124477 | A1 | 5/2011 | Davis | |
| 2011/0281699 | A1 * | 11/2011 | Torres | 482/131 |
| 2011/0287906 | A1 * | 11/2011 | Morris | 482/102 |
| 2012/0202660 | A1 | 8/2012 | Silverman et al. | |

* cited by examiner

EXERCISE DEVICE

CROSS-REFERENCE TO RELATED APPLICATIONS

This application is a Continuation-In-Part application of U.S. patent application Ser. No. 13/223,437, filed on Sep. 1, 2011, the disclosure of which is incorporated by reference in its entirety.

FIELD OF THE INVENTION

The present invention generally relates to an exercise device. More particularly, the present invention pertains to a multi-use elastic exercise device for use in suspension exercises, stretching and resistance training.

BACKGROUND OF THE INVENTION

Suspension exercise devices have long been incorporated into athletic training and therapeutic regimens as an avenue for fitness training, targeted muscle building and muscle therapy, and rehabilitation without the cost and space required with more bulky equipment. In particular, many types of devices and systems have been proposed that leverage gravity and a user's own bodyweight for stretching or performing a wide variety of exercises. Some of these systems rely on rigid straps anchored to a door or a ceiling hook, for example, wherein a user grasps handles provided at respective ends of the straps and leans their body at a chosen angle to do exercises. Changing the body angle relative to the floor or a wall, for example, changes the amount of a user's own bodyweight being held in suspension by the straps. Exercises may thus be made more or less demanding in accordance. Other systems rely on complex combinations of rigid and elastic components to provide varying degrees resistance and support during suspension training. However, all of these systems require constant reconfiguring, such as adding coupling components, adjusting or changing the position of straps and/or anchor points, and/or adding or changing the position of the handles, for example, to set up for exercise and/or for changing or easily establishing different points of leverage to change the difficulty of an exercise performed using the exercise device.

There is a need for a suspension exercise device configured for easy and efficient set up and use that does not require the need to reconfigure the device in order to change the difficulty of the device during use.

SUMMARY OF THE INVENTION

The foregoing needs are met, to a great extent, by the present invention, wherein in some embodiments an exercise device that is capable of overcoming the disadvantages described herein is provided.

According to certain aspects of the present disclosure, an exercise device includes a first strap portion having a first elongate portion and a second elongate portion joined together along a common longitudinal axis at varying points to define a first plurality of loops, a second strap portion having a third elongate portion and a fourth elongate portion joined together along a second common longitudinal axis at varying points to define a second plurality of loops, and an anchoring device. The first strap portion and the second strap portion may be coupled to one another, and the anchoring device may hold or secure the coupled first and second strap portions such that the first plurality of loops and the second plurality of loops extend substantially symmetrically away from the anchoring device.

According to yet other aspects of the present disclosure, a suspension exercise device includes a strap having a plurality of loops and an anchor device for securing the strap to a stationary support, wherein a load applied on one of the loops moves the loop away from the anchor device until a controlled deceleration actuated by the strap prevents further movement of the loop beyond an end point.

There has thus been outlined, rather broadly, certain embodiments of the invention in order that the detailed description herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
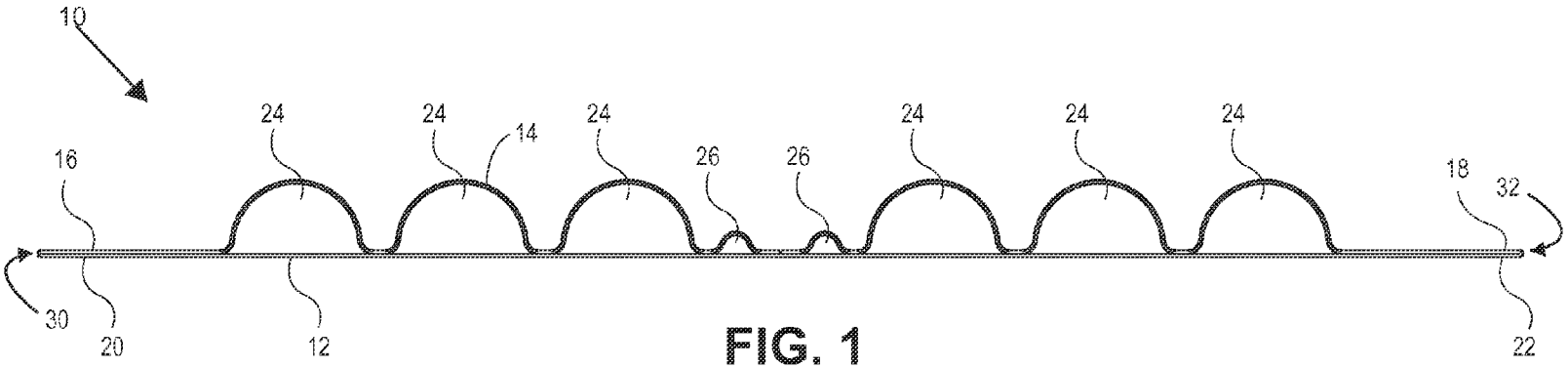
FIG. 1 illustrates a side view of a stretch strap, in accordance with aspects of the present disclosure.

The present invention provides in some embodiments, a device for strengthening and stretching muscles having a series of loops. The device can be formed from strips of elastic material periodically joined in order to form loops. More particularly, a top portion of elastic material can be laid on top of a bottom portion of elastic material. The top and bottom portions of materials can be joined in a variety of ways. A user of the device can engage different body parts with the loops and use the device to facilitate a dynamic stretch of a muscle or to leverage a user's own bodyweight for stretching or performing a wide variety of exercises.

For example, stretching may be a part of a well-rounded physical activity program, along with cardiovascular exercise and strength training. Both muscle fibers and the tissues surrounding those fibers ("fascia") have viscoelastic properties. Stretching soft tissues increases the length of the muscle fibers and to some extent the fascia. A single stretching session can improve a person's short-term range of motion, but these results are short-lived. It has been found that repeated stretching sessions over time provide the best sustained elongation of soft tissue. Indeed, the American College for Sports Medicine ("ACSM") suggests 2 to 4 sets of 15 to 30 seconds of stretching is necessary to improve flexibility in a muscle, at least 2 to 3 days per week.

Generally, there are 2 types of stretching exercises: static stretching and dynamic stretching. Static stretching involves the passive lengthening of the muscle, whereas dynamic stretching involves active contraction prior to the muscle being stretched. Dynamic stretching includes proprioceptive neuromuscular facilitation ("PNF") or "contract-relax" stretching. PNF stretching can decrease the muscle's excitability by reducing reflexive activation, thus reducing its resistance to stretch and enhancing its length.

Additionally, a hybrid PNF-type stretch can be performed by varying the levels of contraction in which the muscle is first contracted and then passively stretched. These techniques are known as post isometric relaxation ("PIR") or post facilitation stretch ("PFS"). More specifically, PIR can be used to reduce trigger point pain, while PFS can be used to alleviate chronic muscle tightness. PIR utilizes a very low, 20% to 25% maximal contraction at end-range before relaxation, while the PFS utilizes 100% maximal contraction performed at mid-range followed by a stretch at end-range.

Suspension exercising is an avenue for fitness training, targeted muscle building and muscle therapy, stretching, and rehabilitation. Suspension exercising uses devices and systems that leverage gravity and a user's own bodyweight for stretching or performing a wide variety of exercises. The leverage and support required to perform suspension exercises at varying degrees of difficulty, for example, is often determined by the angular relationships established between the suspension exercise device, the user, and the exercise device mount. The elasticity of the components used in a suspension exercise device must be controlled so a user can sufficiently establish the leverage and support required when using the device. Too much elasticity in an exercise device, for example, will not allow a user to establish the required angular relationships necessary to leverage in any controlled manner their own suspended weight. Inelastic exercise devices may create a harsh exercise experience for the user and/or limit the range of use of the device by limiting the assistance that may be provided to a user through elastic forces.

The invention will now be described with reference to the drawing figures, in which like reference numerals refer to like parts throughout. FIG. 1 illustrates a side view of a stretch strap device 10 in accordance with an embodiment of the present invention. The stretch strap device 10 includes a base portion 12 and a top portion 14. The base portion 12 can be formed from a length of material having a first end 16 and a second end 18, and the top portion 14 can also be formed from a second length of material having a first end 20 and a second end 22. Alternately, the base portion 12 and the top portion 14 can be formed by folding over a continuous length of a material used to form the base portion 12 and the top portion 14. The stretch strap device 10 can be formed from a material such as polyester, propylene, nylon, or cotton that also incorporates an elastic component such as a natural or synthetic elastomer. In some embodiments, a nylon surrounding a latex cord for elasticity can be used. However, any suitable elastic material can be used to create the base portion 12 and the top portion 14 of the stretch strap device 10. Preferably, the stretch strap device can have an elongation percentage limited to between approximately 40% and approximately 80%. Again, however, any elongation percentage that can be used to yield a dynamic stretch of a muscle can be used.

FIG. 1 also illustrates that the base portion 12 and the top portion 14 can be connected at points along their length, such that a loop 24 is formed between the base portion 12 and the top portion 14. The loops can be connected in any suitable fashion such as sewing or heat bonding. As illustrated in the example device 10 in FIG. 1, there are six large loops 24 and two small loops 26 formed periodically along the length of the device 10. Preferably, there are between approximately 5 to approximately 10 loops along the length of a stretch strap device, but any suitable number of loops can be used. Additionally, the loops can take any size suitable for facilitating a dynamic stretch. For example, the two small loops 26 illustrated in FIG. 1, can be used to engage a user's toe in order to facilitate a dynamic stretch of the foot and leg. Alternately, the stretch strap device 10, need not contain any small loops. The toe loops 26 can be positioned near the middle of the stretch strap device 10, as shown in FIG. 1 or can be positioned anywhere along the length of the stretch strap device 10, such that a foot and/or leg dynamic stretch can be facilitated.

Figure 2:
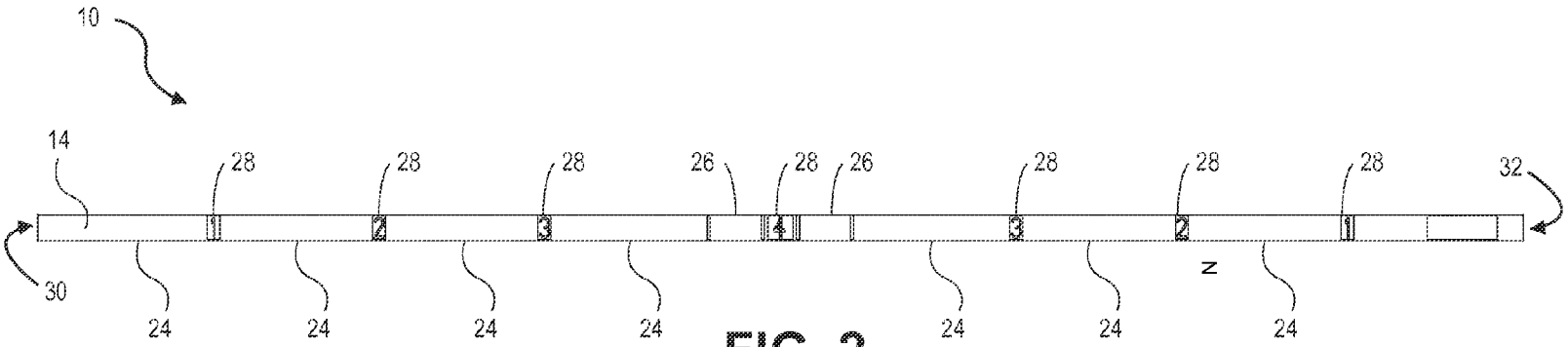
FIG. 2 illustrates a top down view of a stretch strap, in accordance with aspects of the present disclosure.

FIG. 2 illustrates a top down view of the stretch strap device in accordance with an embodiment of the invention. As illustrated in FIG. 2, the stretch strap device 10 can include markers 28. The stretch strap device can include markers 28 in the form of numbers labeling the loops 24 and 26 from one end 30 of the stretch strap device 10 to a second end of the stretch strap device 32. As illustrated in FIG. 2, the markers 28 are positioned between the loops 24, 26 of the stretch strap device 10. While FIG. 2 illustrates the markers 28 taking the form of numbers, this is only one example of a way to mark the different regions of the stretch strap device 10. The markers can also take the form of colors, letters, symbols, patterns, or any other appropriate marking. Additionally, while the markers 28 are shown between the loops 24 and 26, in FIG. 2, the markers can be positioned in any place on the stretch strap device that facilitates the users dynamic stretch.

Figure 3:
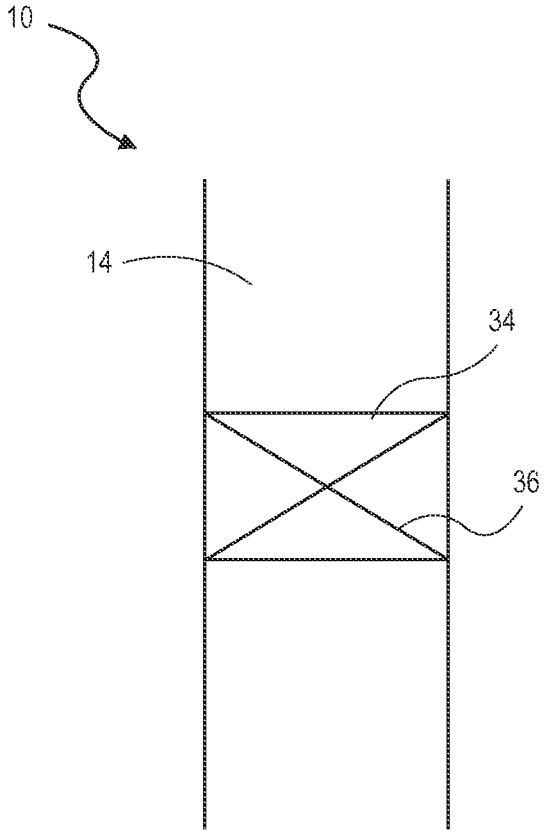
FIG. 3 illustrates a top down view of a schematic diagram of a point of connection of the stretch strap, in accordance with aspects of the present disclosure.

FIG. 3 illustrates a schematic diagram of a box stitch connection in accordance with an embodiment of this invention. As illustrated in FIG. 3, the base portion (not shown) and the top portion 14, of the stretch strap device 10, can be joined by sewing the two pieces of material together. In the example illustrated in FIG. 3, the base portion and the top portion 14 are connected using a simple box stitch connection. The connecting stitch is formed by stitching a box-shape 34 and stitching an x-shape 36 within the boundaries of the box-shape 34. This stitch provides durability such that the stretch strap device 10, can be used to facilitate a dynamic stretch.

Figure 4:
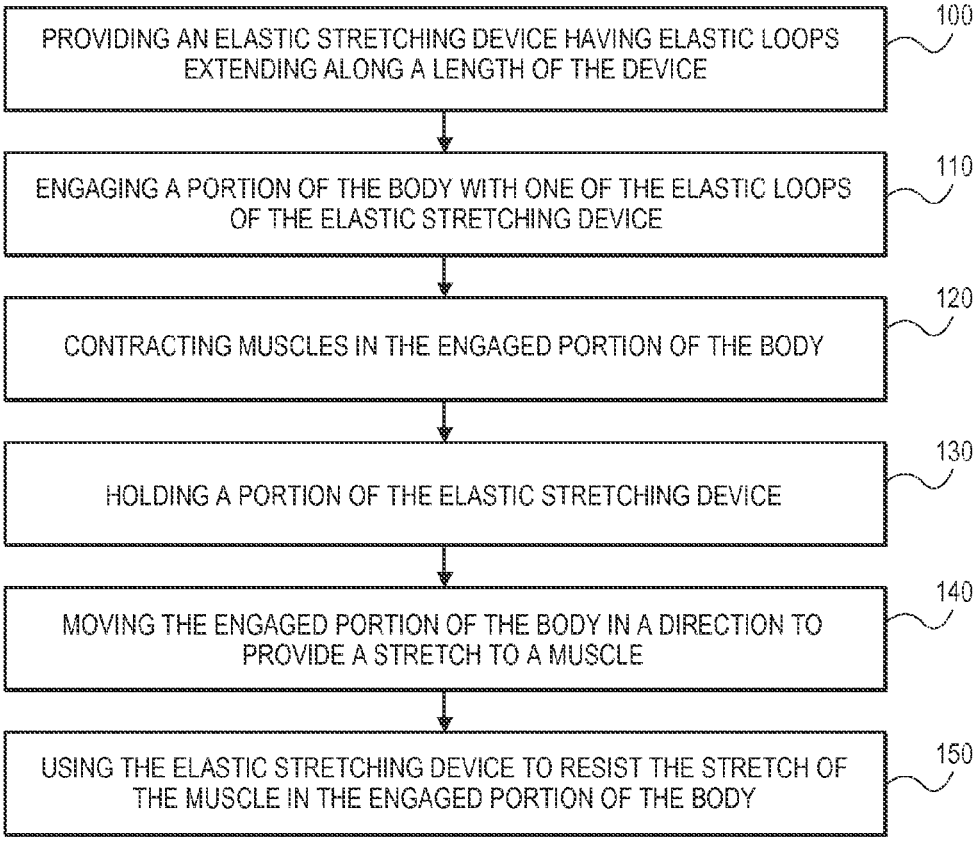
FIG. 4 illustrates a diagram of a method of stretching, in accordance with aspects of the present disclosure.

FIG. 4 illustrates a method of performing a dynamic stretch using a stretch strap in accordance with an embodiment of the invention. The method can include step 100 which provides an elastic stretching device having elastic loops extending along a length of the device. The elastic stretching device can take the form of the example device described with respect to FIGS. 1-3 or can take the form of any stretch strap device that can be used for a dynamic stretch. Step 110 can include engaging a portion of the body with one of the elastic loops of the elastic stretching device and step 120 can include contracting muscles in the engaged portion of the body. During the stretch the user can execute step 130 of holding a portion of the elastic stretching device. The method can also include step 140 of moving the engaged portion of the body in a direction to provide a stretch to a muscle. Additionally, the method can include step 150 of using the elastic stretching device to resist the stretch of the muscle in the engaged portion of the body.

Figure 5:
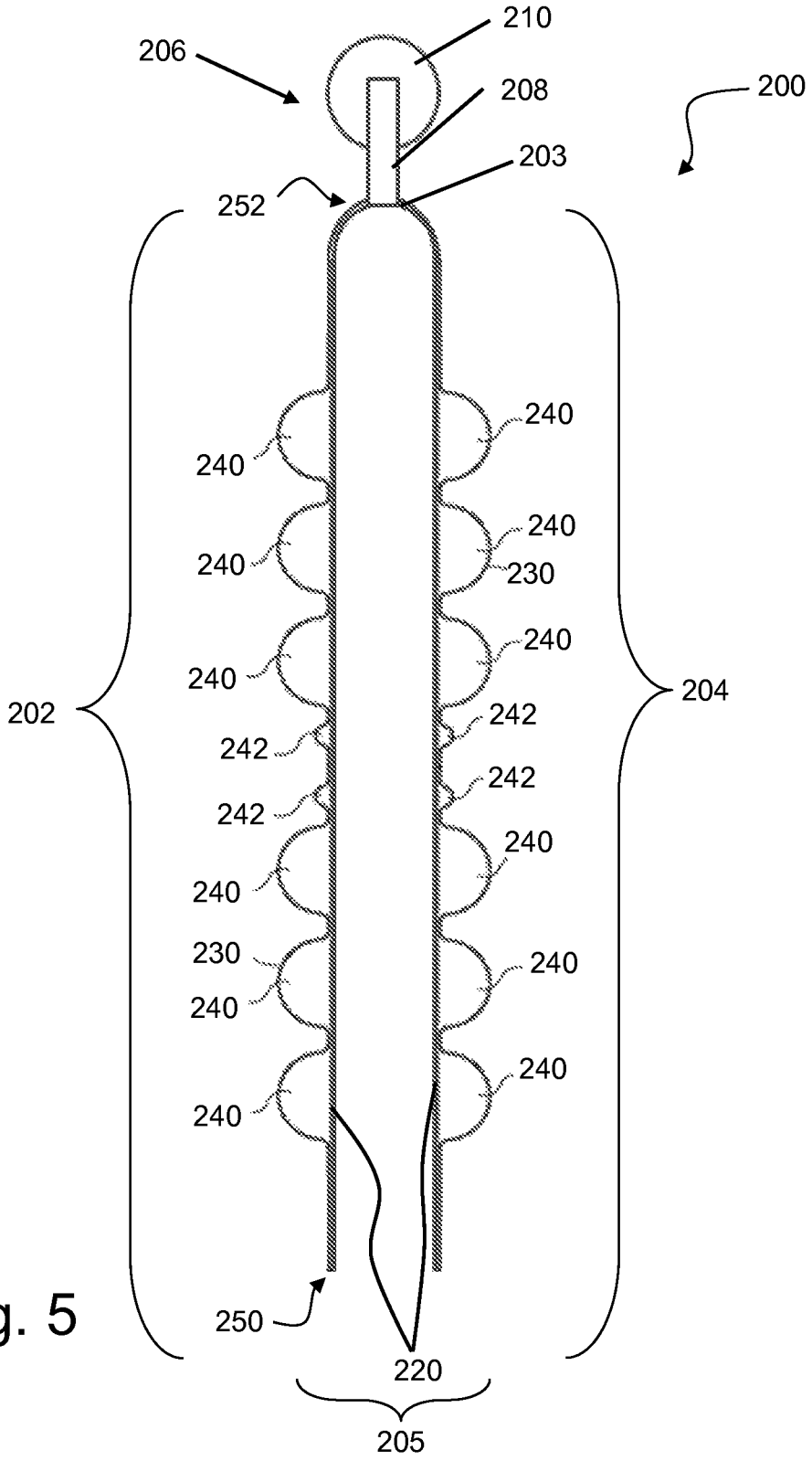
FIG. 5 illustrates a front view of an exercise device, in accordance with aspects of the present disclosure.

FIG. 5 illustrates a side view of a suspension exercise device 200 in accordance with an embodiment of the present invention. The exercise device 200 may include a first elastic strap portion 202 coupled to a second elastic strap portion 204 to form a strap assembly 205 wherein the first elastic strap portion 202 and the second elastic strap portion 204 extend substantially symmetrically from an anchoring device 206. The anchoring device 206 may be any suitable means for anchoring the exercise device 200 to a suitable support. For example, as shown in FIG. 5, the anchoring device 206 may include a support strap 208, which may be formed from a nylon webbing material or other suitable material and coupled to a door anchor 210 toward a distal end. The support strap 208 may be a continuous loop having a section directly attached to the strap assembly 205 near a central portion 203. In accordance with another aspect of the present disclosure, the support strap 208 may be configured to allow the coupled strap portions 202 and 204 to be freely supported through the loop in a manner to allow the coupled strap portions 202 and 204 to slide through a proximal portion of the support strap 208. In accordance with yet other aspects of the present disclosure, the anchoring device 206 may include a carabineer and the support strap 208 coupled to the carabiner at a distal end, for example, for hooking onto a stable support hook in a wall or ceiling. Alternatively, the carabineer may be directly connected to one or both of the strap portions 202 and 204 to be configured as the anchoring device 206.

Each of the elastic strap portions 202 and 204 may be similarly formed. As such, like reference numerals will be used to describe like components of the each of the strap portions. Each elastic strap portion 202 and 204 may include a base portion 220 and a top portion 230. The base portion 220 can be formed from two lengths, joined in any suitable manner, for example, at the ends or at another point to form loops at one or more distal ends of the elastic strap portion. Alternately, the base portion 220 and the top portion 230 can be formed by folding over a continuous length of a material used to form the base portion 220 and the top portion 230. In accordance with yet other aspects of the present disclosure, the two elastic strap portions 202 and 204, rather than being separately formed components that are coupled, may be portions of an integrally formed strap having one base portion 220 and one top portion 230 joined at both ends or in any suitable manner to form a strap assembly 205 having the two elastic strap portions 202 and 204 described herein. In accordance with yet another aspect of the present disclosure, the integrally formed strap assembly 205 may include a base portion 220 and top portion 230 configured from one continuous length of material folded over, for example, to form loops 240 at both distal ends of the first elastic strap portion 202 and the second elastic strap portion 204.

The top portion 230 and the base portion 220 of the elastic strap portions 202 and 204 may be formed from a material such as polyester, propylene fabric, nylon, or cotton that also incorporates an elastic component such as a natural or synthetic elastomer. In some embodiments, a nylon surrounding a latex cord for elasticity can be used to form elastic nylon webbing. Preferably, the material allows the exercise device to have an elongation percentage of between approximately 40% and approximately 80% along a longitudinal axis, although any suitable longitudinal elongation percentage may be provided.

FIG. 5 also illustrates that the base portion 220 and the top portion 230 can be connected at points along their length, such that a loop 240 is formed between the base portion 220 and the top portion 230. The loops can be connected in any suitable fashion such as sewing or heat bonding. As illustrated in the example device 200 in FIG. 5, there may be a number of larger loops 240 and a number of smaller loops 242 formed periodically along the length of each of the elastic strap portions 202 and 204. Preferably, there may be between approximately 5 to approximately 10 loops along the length of each strap portion 202 and 204, but any suitable number of loops may be used. Additionally, the loops can take any size suitable for facilitating a dynamic stretch if used as a stretching device and/or for forming grasping/supporting loops/handles when used as a suspension device. For example, the smaller loops 242 illustrated in FIG. 5, may be used to engage a user's toe in order to facilitate a dynamic stretching or exercising of the foot and leg, for example. The smaller loops 242 may be positioned near the middle of one or both of the elastic strap portions 202 and 204, as shown in FIG. 5, or can be positioned anywhere along the length of each of the elastic strap portions 202 and 204 to facilitate a particular positioning of a foot and/or leg, for example, to accommodate a dynamic stretch or a particular exercise when the device 200 is positioned on a door. Alternately, the exercise device 200 need not contain any small loops 242.

The exercise device 200 provides an apparatus and method to facilitate performing a stretch where the muscle is actively contracted at different levels of activation and then passively stretched. For example, the exercise device 200 may be used independently of any anchor supports for stretching exercises using "contract-relax" methods described above that are made possible by the elastic nature of the device 200.

FIG. 5 illustrates that the loops 240 or 242 may be formed to stand up or lie flat. For example, a portion of the top portion 230 forming a particular loop may be dimensioned to have a greater longitudinal length than the portion of the base portion 220 forming that particular loop. Accordingly, the top portion of a particular loop 240 or 242 may stand out from a section of the base portion forming the remainder of the loop 240 or 242. Similarly, the loops 240 or 242 may be formed so that each section of the top portion and base portion forming a particular loop are approximately equal in length such that the loop 240 or 242 will lie flat when the exercise device 200 is in a general state of rest or, in particular, when the exercise device 200 is in a state of use, under tension, and the particular loop 240 or 242 is not being used as a loop or handle.

Figure 6:
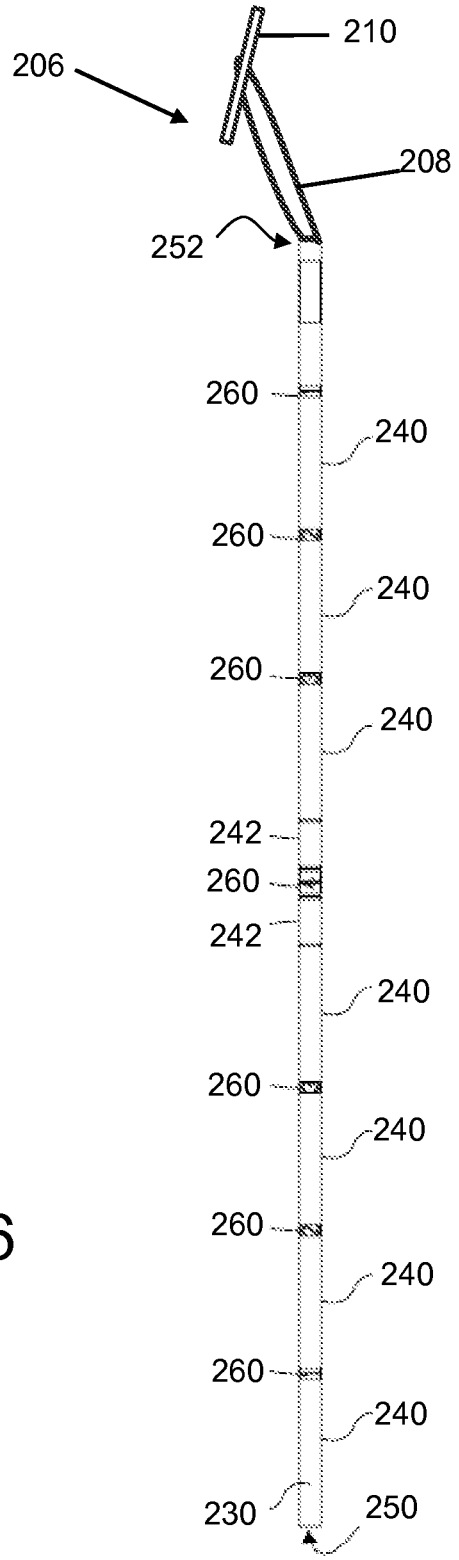
FIG. 6 illustrates a side view of an exercise device, in accordance with aspects of the present disclosure.

FIG. 6 illustrates a side view of the exercise device 200 in accordance with an embodiment of the invention. As illustrated in FIG. 6, each elastic strap portion 202 or 204 may include markers 260 in the form of numbers labeling the loops 240 and 242 at predetermined positions between one end 250 of one or both elastic strap portions to a second end 252 of one or both of the elastic strap portions. As illustrated in FIG. 6, the markers 260 may be positioned between the loops 240, 242 on each of the strap portions. While FIG. 6 illustrates the markers 260 taking the form of numbers, this is only one example of a way to mark the different regions of the elastic strap portions. The markers may also take the form of colors, letters, symbols, patterns, or any other appropriate marking. Additionally, while the markers 260 are shown between the loops 240 and 242, in FIG. 6, the markers may be positioned in any place on the elastic strap portions 202 and 204 that facilitates use of the exercise device 200.

Figure 7:
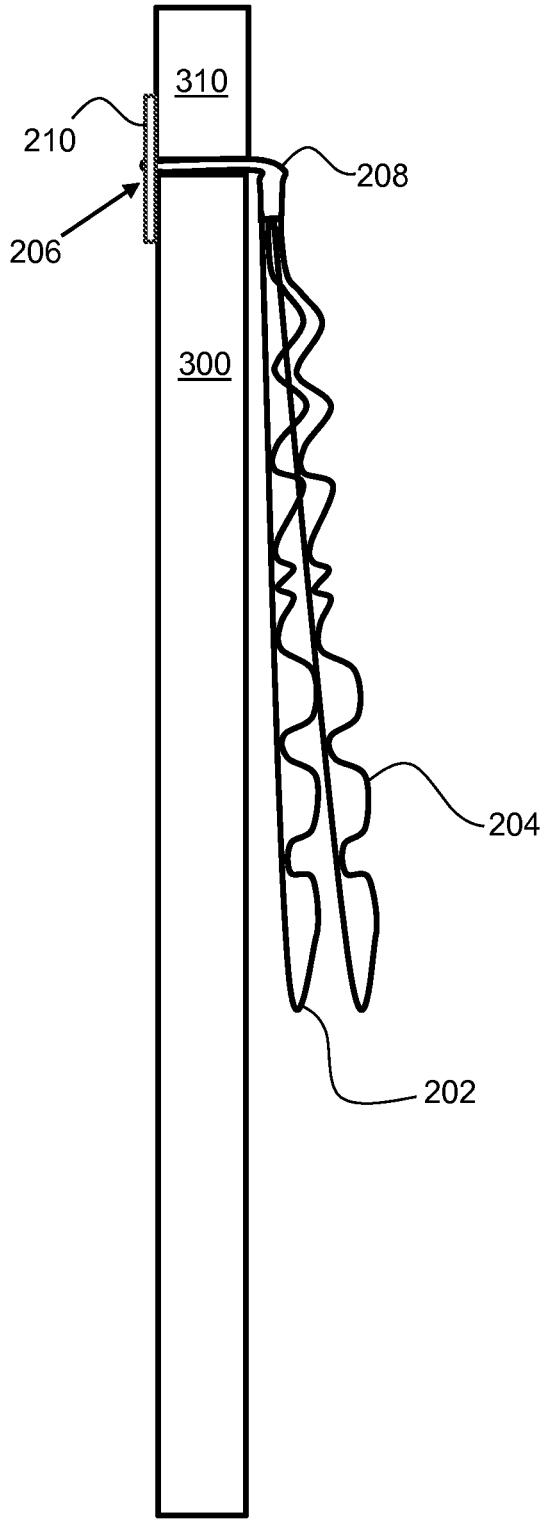
FIG. 7 illustrates a side view of an exercise device in a state of use, in accordance with aspects of the present disclosure.

FIGS. 6 and 7 illustrate that the anchoring device 206 may be coupled to the elastic strap portions 202 and 204 toward the second end 252. Thus, as shown in FIG. 7, with a door 300 slightly ajar, the door anchor 210 may be slid between the door 300 and a door jamb 310, for example, along the upper lateral surface of the door, and the door 300 closed, so that the door anchor 210 may be secured in a holding position on one side of the door 300 with each of the elastic strap portions 202 and 204 hanging freely on the other side of the door. The support strap 208 may be conducted through the space between the door and the door jamb so that, in combination with the door anchor 210, when the door is closed, the exercise device 200 is securely anchored in a position to enable a user to safely use the exercise device 200.

Figure 8:
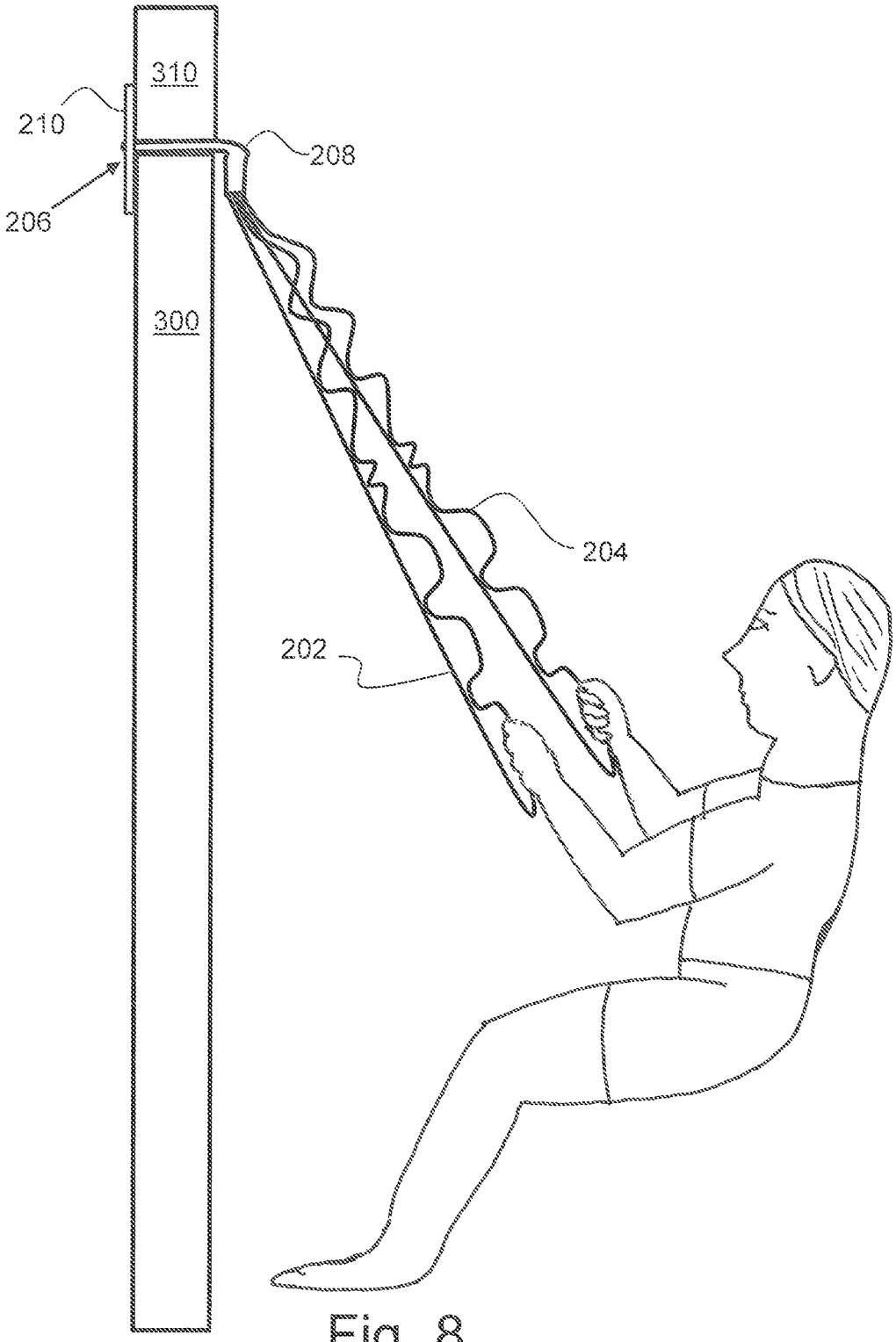
FIG. 8 illustrates another side view of an exercise device in a state of use, in accordance with aspects of the present disclosure.

The multiple loops 240 and 242 on each of the elastic strap portions 202 and 204 of the exercise device 200 may be used as handles for grasping the strap portions 202 and 204 at different locations. To illustrate the concept of using the exercise device 200, a user doing an exercise is shown in FIG. 8. The user may grasp one loop 240 of each of the elastic strap portions 202 and 204 in each hand. The user may assume a position in which they are generally relying on the exercise device 200 to support their weight. The amount of weight suspended may depend on the angle the user assumes for a particular exercise. In this regard, the various loops 240 and 242 may serve as different progression points for a user to easily and effectively chart progress and/or easily and quickly provide varying degrees of difficulty for the same exercise. By staying at exactly the same spot to start an exercise, such as a predetermined distance from the door, the user may, for example, grasp different loops 240 or 242 to change the end angle at which the exercise will be completed. In so doing, the angle may be lessened or increased, for example, by respectively using loops that are closer or further from door when the exercise is being performed. The relative amount of overall stretch in the system changes depending on the loops 240 or 242 selected for use. Accordingly, different points of leverage may be established during a given exercise by simply using different loops 240 or 242 without the need to adjust straps and/or anchoring points, for example, as is typically required in conventional suspension systems.

Referring back to FIG. 8, the user may lean away from the door and/or let his/her arms straighten to begin the loading motion and force the device 200 to support a portion of the user's weight. The elastic nature of the strap portions 202 and 204 allow the exercise device to progressively stretch as the user suspends his/her weight until the device 200 reaches a hard stop, which may be dictated by the less elastic materials used to construct the nylon webbing. At this point, the user has determined an angle, for example by positioning their body a certain distance from the door and/or by selecting which loops 240 to grasp, that dictates how much of their weight will be effectively suspended by the exercise device 200 while performing a given exercise. From the fully-extended position in which the exercise device 200 is under maximum load, the user may then pull himself/herself towards the door with either arm or both arms together until reaching a point when most or all of the loading is released from the exercise device 200. As the load is released, the elastic strap portions 202 and 204 retract from the stretched position back toward the original untensioned positions. The user may then lean back again and/or allow his/her arms to straighten, for example, to reload the exercise device 200 under their suspended weight and perform another repetition of the exercise. The number and variety of exercises that may be performed in this manner are greatly enhanced by the closed system of loops 240 and 242 that provide multiple built-in handles for grasping the elastic strap portions 202 and/or 204 at different locations. The loops may also be used to support a user's feet, arms, and portions of their legs.

For many users, bodyweight exercises can be extremely difficult to accomplish a full range of motion for some exercises. The elasticity of the exercise device 200 provides dual benefits during the full range of motion of a given exercise, namely during both the loading phase and the unloading phase. As a user allows their weight to load the elastic strap portions 202 and/or 204, the elasticity of the device provides a deceleration effect as the user approaches the fully extended position and the material is stretched to its limit. The gradual deceleration that occurs provides for a soft landing as the user reaches the end limit or stop point of the loading motion. On the contrary, the hard-stop often experienced with conventional rigid strap suspension systems occurs without any gradual deceleration, wherein the full force of the suspended weight is felt all at once by the user at the end point of the loading motion, which may produce a jarring impact to muscles and joints. Furthermore, during the unloading motion, an acceleration effect is experienced by the user as the elastic strap portions 202 and 204 attempt to resume their natural, un-stretched positions. The elasticity of the exercise device 200 may thus provide an assisting force to the user's advantage during the unloading motion of an exercise.

In addition, conventional suspension exercise systems are limited to bodyweight exercises and require anchoring to an object, such as a door or ceiling, for example, to function properly. The exercise device 200 provides the added benefit that it may easily and efficiently be converted from use as a suspension device, i.e., a closed-chain bodyweight exercise, to function as a stretching or open-chain resistance exercise device.

Figure 9:
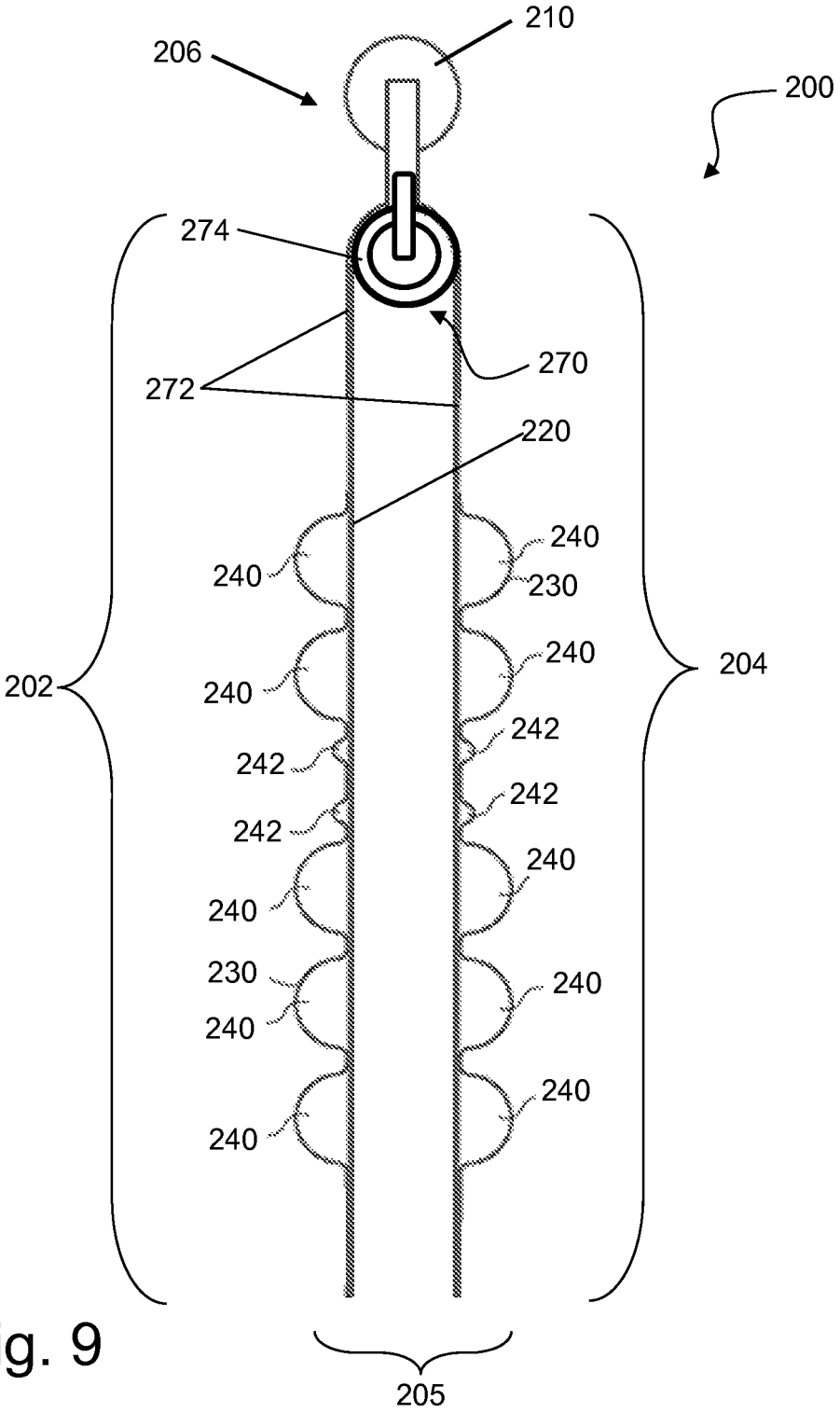
FIG. 9 illustrates front view of an exercise device incorporating a pulley, in accordance with aspects of the present disclosure.

FIG. 9 illustrates other aspects of an exercise device in accordance with the present disclosure. The anchoring device 206 may include a pulley assembly 270. The pulley assembly 270 may be separately attached to the anchoring device 206 and or may be an integral component of the anchoring device 206. As shown in FIG. 9, the strap assembly 205 may be configured to include an extended center area 272, wherein the elastic strap portions 202 and 204 are not configured with loops 240 or 242 in that region. The extended center area 272 may be a single layer of material, such as a single layer of the base portion 220, or a double layer, for example, wherein the top portion 230 and the base portion 220 are joined together to lie flat for the entire longitudinal length of the extended center area 272. The extended center area 272 may thus be mounted onto the pulley wheel 274 to allow a user to perform rotational movements during use of the exercise device 200. Each of the separate elastic strap portions 202 and 204 are then able to simultaneously move in opposing directions via rotation of the pulley wheel 274. A locking mechanism on the pulley 270 and/or the anchoring device 206 may be provided to disengage or lock the pulley 270 from rotating. In accordance with yet another aspect of the present disclosure, the anchor device may include a separate mounting location, wherein the elastic strap portions 202 and 204 may be moved between mounting positions to engage or disengage a rotational capability.

Figure 10:
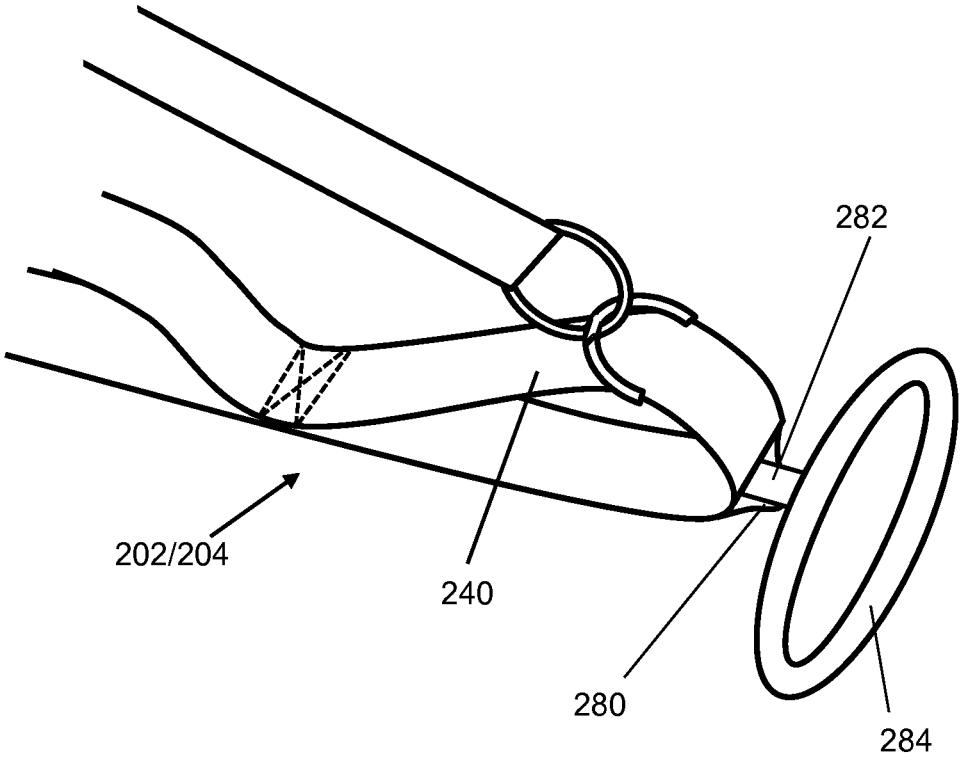
FIG. 10 illustrates various elastic band or tube features for use with an exercise device, in accordance with aspects of the present disclosure.

As shown in FIG. 10, a fabric sock 280 may be sewn or otherwise coupled to the back side of the coupled elastic strap portions 202 and 204, the back side being the side of the elastic strap portions 202 and 204 opposite from the loops 240. An elastic resistance tube 282 may be run through the sock 280 with handles 284 or any other suitable grasping means attached at the ends. Thus, if the user chooses to use suspension as the exercise method, the users simply grabs the appropriate loops 240 and uses the exercise device 200 as discussed above. If, on the other hand, straight elastic resistance is desired, the user may instead grasp the handles 284 and use the exercise device 200 as one would a conventional resistance trainer, wherein the resistance tube 282 will stretch and relax within the sock 280.

In accordance with other aspects of the present disclosure, as also shown in FIG. 10, one or more D-rings 290, or any other suitable attachment device, may be sewn into or provided on one or more of the loops 240 or 242 serving as handles on the elastic strap portions 202 and 204. Another D-ring, or any other suitable attachment device, may be added to the anchoring device 206. An elastic resistance band 292, or elastic tubing, for example, may then be removably attached between the loop 240 and the anchoring device 206 to provide additional assist during an exercise. Similarly, resistance bands and or tubing may be attached between various loops 240, which, for example, may serve to assist a user in keeping or bringing their hands back together during a particular exercise. The added connection between loops 240 serving as handles may be particularly beneficial for a user engaged in exercises using the pulley 270 discussed above.

Figure 11:
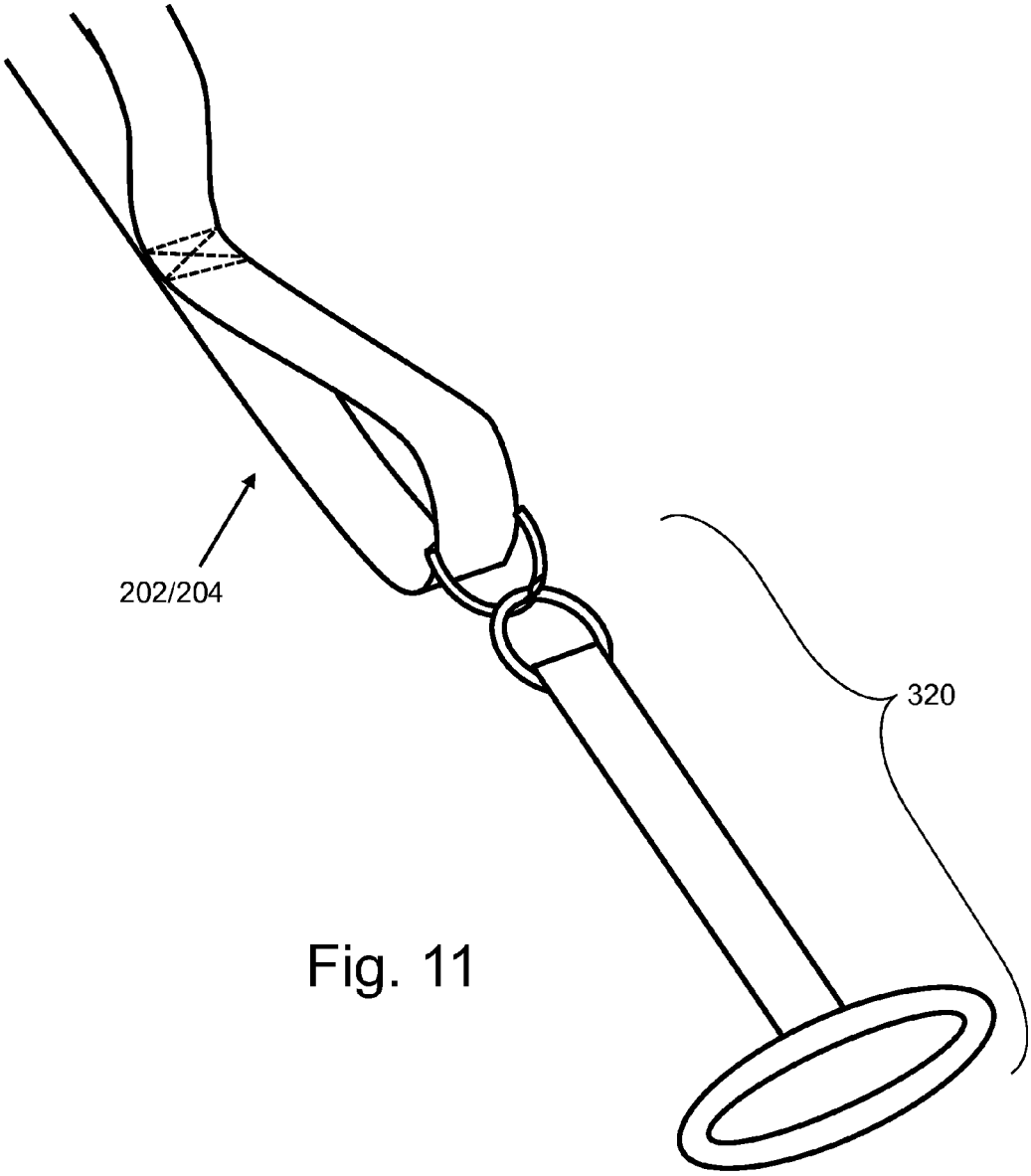
FIG. 11 illustrates an elastic feature for use with an exercise device, in accordance with aspects of the present disclosure.

As shown in FIG. 11, in addition to elasticity being incorporated into the main strap assembly, i.e., the strap portions 202 and 204, removable handle assemblies 320 may be coupled to one or both of the strap portions 202 and 204. The handle assemblies 320 may be formed with elastic tubing or straps, for example, to provide a certain degree of elasticity and may be attached or coupled to the strap portions 202 and 204 at the ends of the strap portions 202 and 204 or at any other point along the longitudinal length of the strap portions 202 and 204. For example, the handle assemblies 320 may attach to one or more loops 240 or 242 via D-rings 290, as illustrated in FIG. 10, or by any other suitable coupling or attachment means. In accordance with aspects of the present disclosure, progressive levels of assistance may be provided to a user performing suspension exercises by switching between handle assemblies 320 having different levels of elastic resistance.

The many features and advantages of the invention are apparent from the detailed specification, and thus, it is intended by the appended claims to cover all such features and advantages of the invention which fall within the true spirit and scope of the invention. Further, because numerous modifications and variations will readily occur to those skilled in the art, it is not desired to limit the invention to the exact construction and operation illustrated and described, and accordingly, all suitable modifications and equivalents may be resorted to falling within the scope of the invention.

What is claimed is:

1. An exercise device comprising:

a first elastic strap portion having a first elongate portion and a second elongate portion joined together along a first longitudinal axis at a plurality of first connections to define a first plurality of loops;

a second elastic strap portion having a third elongate portion and a fourth elongate portion joined together along a second longitudinal axis at a plurality of second connections to define a second plurality of loops;

an anchoring device;

an elastic resistance tube having a suitable grasping means coupled to at least one end, wherein the elastic resistance tube is mounted onto at least one of the first elastic strap portion or the second elastic strap portion and configured to provide elastic resistance through extension and retraction of the elastic resistance tube by way of the grasping means; and a fabric sock attached to a back side of the at least one of the first strap portion or the second strap portion, wherein the elastic resistance tube is run through the fabric sock to expose the end having the grasping means; and wherein the first elastic strap portion and the second elastic strap portion are coupled to one another and the anchoring device is configured to hold or secure the coupled first and second elastic strap portions such that the first plurality of loops and the second plurality of loops extend a predetermined length substantially symmetrically away from the anchoring device; and wherein an elastic elongation of the first elastic strap portion along the first longitudinal axis and the second elastic strap portion along the second longitudinal axis is limited to between approximately 40% and approximately 80% of the predetermined length.

2. The exercise device of claim 1, wherein the anchoring device includes a support strap formed to be a continuous loop having a distal end and a proximal portion, and a door anchor coupled to the distal end of the support strap.

3. The exercise device of claim 2, wherein the first elastic strap portion and the second elastic strap portion are directly coupled and freely supported by the proximal portion of the support strap such that the coupled first elastic strap portion and second elastic strap portion are capable of sliding through the proximal portion of the support strap.

4. The exercise device of claim 1, wherein the first elastic strap portion and the second elastic strap portion are integrally coupled to include an extended center area free of loops.

5. The exercise device of claim 4, wherein the anchoring device includes a pulley assembly configured for mounting the extended center area of the integrally coupled first elastic strap portion and second elastic strap portion.

6. The exercise device of claim 1, further comprising:

an attachment device affixed to a loop of the first plurality of loops or the second plurality of loops; and a removable handle assembly coupled to the attachment device, the removable handle assembly formed to provide a certain degree of elastic resistance.

7. The exercise device of claim 6, wherein the removable handle assembly is selected from one of a set of handle assemblies, each handle assembly providing a different degree of elastic resistance.

8. The exercise device of claim 1, wherein a load applied on one of the loops of the first plurality of loops or the second plurality of loops moves the loop away from the anchor device until a controlled deceleration actuated by the strap prevents further movement of the loop beyond an end point.

9. The exercise device of claim 1, wherein the plurality of first connections and the plurality of second connections are box stitch connections formed by stitching a box-shaped boundary and stitching an x-shaped pattern inside the box-shaped boundary.

10. The exercise device of claim 1, wherein a longitudinal length of the first elongate portion for each loop of the first plurality of loops is greater than a longitudinal length of the second elongate portion for each loop of the first plurality of loops.

11. The exercise device of claim 1, further comprising:

an attachment device affixed to a loop of the first plurality of loops or the second plurality of loops, wherein an elastic resistance band is directly mounted between the anchoring device and the attachment device to provide additional assist during an exercise involving the loop.

* * * * *